United States Patent [19]

Spector

[11] 4,148,479

[45] Apr. 10, 1979

[54] HYDRAULIC FORCE RESISTER

[76] Inventor: Donald Spector, 380 Mountain Rd., Union City, N.J. 07087

[21] Appl. No.: 809,774

[22] Filed: Jun. 24, 1977

[51] Int. Cl.[2] ..... A63B 21/00

[52] U.S. Cl. ..... 272/130; 272/143; 272/DIG. 5

[58] Field of Search ..... 272/130, 143, DIG. 4, 272/DIG. 5, 67, 125; 16/82, 49; 251/48, 54, 63; 188/316, 317; 73/379

[56] References Cited

U.S. PATENT DOCUMENTS

| | | | |
|---|---|---|---|
| 767,008 | 8/1904 | Pelletier et al. | 272/130 |
| 2,825,563 | 3/1958 | Lawton | 272/130 |
| 3,782,722 | 1/1974 | Webb | 272/DIG. 5 X |
| 3,834,696 | 9/1974 | Spector | 272/130 |

FOREIGN PATENT DOCUMENTS

| | | | |
|---|---|---|---|
| 328496 | 12/1903 | France | 272/130 |
| 1394245 | 5/1975 | United Kingdom | 272/130 |
| 1445222 | 8/1976 | United Kingdom | 272/130 |

*Primary Examiner*—Richard C. Pinkham
*Assistant Examiner*—William R. Browne
*Attorney, Agent, or Firm*—Michael Ebert

[57] ABSTRACT

A push-pull isokinetic exerciser composed of inner and outer telescoping tubes whose ends have handle pieces attached thereto. The inner tube defines an oil-filled chamber which encloses a piston whose actuating rod is attached to the handle end of the outer tube. The piston divides the chamber into right and left sections provided with valves that function alternately to allow oil to pass from the right section to the left section when the tubes are brought together by the handle pieces in a compression stroke, and that allow oil to pass from the left section to the right section when the tubes are pulled apart in an expansion stroke. The motion in the compression and expansion strokes is linear and affords uniform resistance to motion throughout the entire length of each stroke, so that the exercising effect is even and free of strain. Each handle piece is constituted by a cap which covers and protects the end of the tube to which it is attached, a U-shaped yoke secured to the base of the cap and having arms projecting therefrom and a handle bridging the arms, the handle having a longitudinal bore therein to receive the mid-section of a crossbar, whereby the user may engage the handle piece with either hand or foot, or may engage the ends of the crossbar protruding from the handle with both hands or both feet.

6 Claims, 8 Drawing Figures

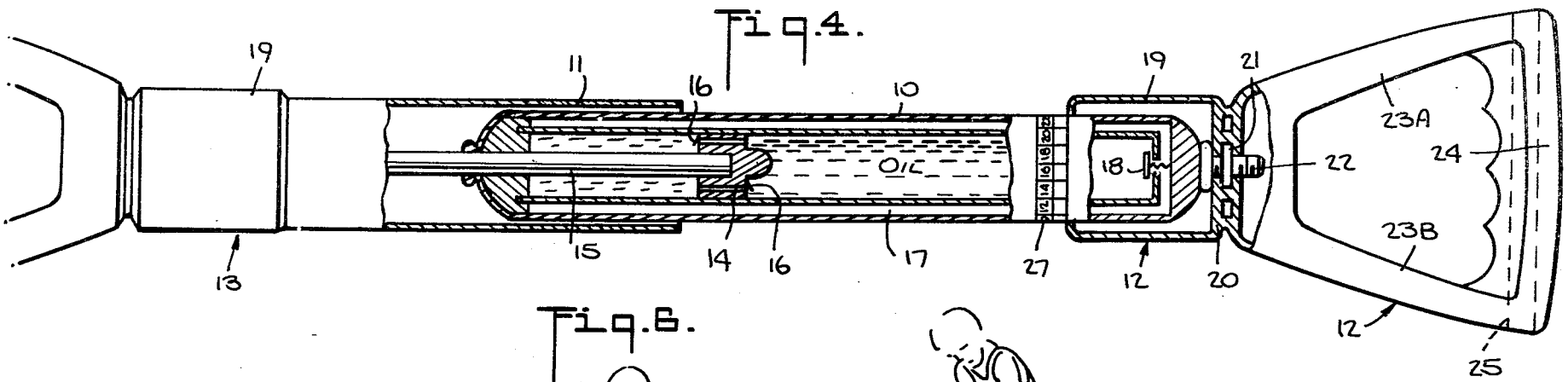
Fig. 4.
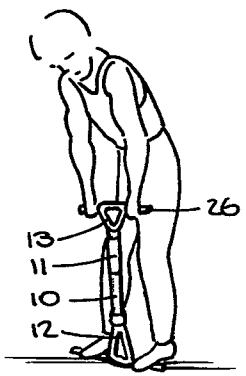
Fig. 7.
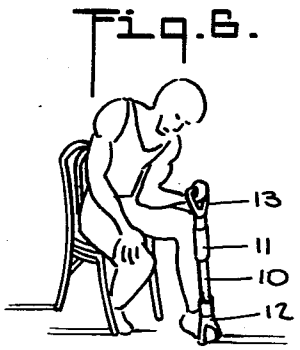
Fig. 6.
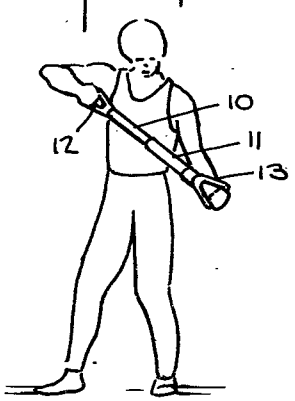
Fig. 5.
| Fitness Level / MWU Cycles | Level I Sub-Par | | Level II Minimum | | Level III Average | | Level IV Physically Gifted | | Level V Superman | |
|---|---|---|---|---|---|---|---|---|---|---|
| Muscle Working Units (lbs) | 13 | 27 | 40 | 53 | 67 | 80 | 93 | 106 | 120 | 133 | 146 | 160 | 173 | 187 | 200 |
| Cycles Per Minute | 2 | 4 | 6 | 8 | 10 | 12 | 14 | 16 | 18 | 20 | 22 | 24 | 26 | 28 | 30 |
Fig. 8.

HYDRAULIC FORCE RESISTER

BACKGROUND OF INVENTION

This invention relates generally to manual exercisers suitable for athletic or therapeutic purposes, and more particularly to an isokinetic exerciser in the form of a push-pull hydraulic device provided with a pair of handle pieces and requiring an evenly applied muscular force to effect compression or expansion.

In contemporary society, large-scale mechanization has sharply reduced the need for an expenditure of physical energy in the production of goods and services. Indeed, the aim of most inventions is to provide a labor-saving device to supplant human effort. But while modern man has been relieved of the Biblical injunction to earn his daily bread by the sweat of his brow, this has been a mixed blessing; for the resultant inactivity has given rise in affluent societies to serious obesity problems and has impaired the ability of many persons to carry out their normal tasks with a reasonable degree of efficiency.

To remediate many of the physical fitness problems of the sedentary individual, various forms of exercisers have been contrived that are designed to develop muscular strength and endurance. By muscular strength is meant the measurable strength of muscles as determined by a single maximum contraction, and by muscular endurance is meant the ability of muscles to perform work for a given time period.

Most exercisers in current use fall either into the isometric or isotonic class. An isometric exerciser is designed to sustain one muscular contraction and therefore operates on static tension, whereas an isotonic exerciser adapted to repeatedly raise or lower a weight or other load brings into play dynamic tension.

In a review by the President's Council on Physical Fitness and Sports of the research carried out on the comparative effects of isometric and isotonic training programs, as reported in the *Physical Fitness Research Digest* of Jan. 1974 (Series 4, No. 1), the Council indicated a preference for the isotonic over the isometric form and concluded that isotonic training is superior in developing muscular strength and in improving muscular endurance. The Council pointed out that motiviation is greater in isotonic exercising, for the participant can see what is being accomplished and explicit goals may be set. This does not mean that isometric exercising is less valuable, for it is useful in developing muscular strength in circumstances which preclude isotonic training.

But from the standpoint of overall physical fitness enhancement, neither isotonic nor isometric forms of exercise are adequate, for these exercises fail to contribute in any appreciable degree to the improvement of circulatory-respiratory endurance, an important aspect of well-being.

In recent years, a third training technique has been developed by experts in the physiology of exercise and physical therapy to improve overall physical fitness. This new technique, which combines the best attributes of isotonic and isometric training, has been designated isokinetic training. In isokinetic exercise, maximum dynamic tension is developed throughout a range of motion.

When performing isotonic or isometric exercises, strength development is not achieved equally throughout the range of motion. In isotonic exercise, the magnitude of isotonic resistance must be limited to the largest load that can be moved at the weakest point in some range of motion. This resistance will therefore be less than maximum during the rest of the range and thus will not load the muscle to its full tension-developing capacity in much of its shortening range. Moreover, in isotonic training, the exercise speed is subject to considerable acceleration and is therefore unstable and unpredictable.

On the other hand, isometric exercise takes place against a load which prevents external movement and offers resistance inherently proportional to the muscle's static tension-developing capacity at one shortening length. No dynamic work at all is carried out; hence the intrafiber power developed is inherently restricted.

The present invention, which operates on isokinetic principles, constitutes an improvement over the hydraulic double-acting exerciser disclosed in applicant's prior U.S. Pat. No. 3,834,696. In this prior exerciser, handles are attached to the ends of a hydraulic bar formed by inner and outer telescoping tubes in an arrangement in which the handles are attached to bolts extending from the ends of the tubes so that the handles are spaced from the ends. As a consequence, the ends of the tubes are unprotected, and, in practice, the clothing of the user may be caught in the spaces between the handles and the tube ends.

SUMMARY OF INVENTION

In view of the foregoing, the main object of this invention is to provide an isokinetic exerciser of the push-pull type which offers substantially uniform resistance to motion throughout the entire range of its compression and expansion strokes and which requires an evenly-applied muscular force to effect such motion in either direction of movement.

More particularly, it is an object of this invention to provide a push-pull exerciser that requires the effort and work of the isometric technique while offering the weight resistance of the isotonic form, thereby combining the best aspects of both forms.

A significant feature of the invention is that the user is able to perform an entire range of motion against maximum resistance—determined at his own level—throughout each phase, making it possible to effect total muscular development for each part of the body worked on.

Because an exerciser in accordance with the invention takes the muscles of the exerciser through a complete cycle of contraction and relaxation, its action is compatible with nature, for muscles work in groups which oppose each other. Thus when an individual makes a muscle in his arm, his bicep group is caused to contract, whereas his tricep group on the underside of the arm undergoes relaxation.

Another important advantage of a push-pull exerciser in accordance with the invention is that it gives rise to fewer painful after-effects and minimal fatigue. Underlying this advantage is the fact that when the body is exercising, it burns energy, thereby generating circulation and blood sugar by-products. Rest time is needed to discharge these exercise residuals; but because isometric and isotonic exercisers do not allow rest time, these forms are physically tiring. An isokinetic exerciser in accordance with the invention affords a brief rest or recovery period as each phase of the working cycle transfers from contraction to relaxation to eliminate exercise residuals. The lack of discomfort associated with this isokinetic exerciser acts as an incentive for exercising regularly.

Also an object of this invention is to provide a push-pull exerciser usable in a great variety of exercising positions to develop different parts of the body, the exerciser having crossbar-receiving handle pieces at either end thereof such that the handle pieces may be engaged by one or both hands or one or both feet to fully exploit the exercising potential of the device. Thus the user may grip the device between two hands, or between one hand and one foot or between two hands and two feet.

Yet another object of the invention is to provide an isokinetic exerciser which affords instant feedback regarding the performance of the exerciser on a scale of performance levels.

Still another object of the invention is to provide an exerciser having a hydraulic bar formed by telescoping tubes whose ends are protectively covered by the handle pieces attached thereto.

Briefly stated, these objects are attained in a push-pull hydraulic exerciser comprising a bar formed by inner and outer telescoping tubes whose ends have handle pieces attached thereto, whereby the tubes may be pulled apart or brought together, the inner tube also being rotatable relative to the outer tube. The inner tube defines a chamber which is oil-fitted and encloses a piston whose actuating rod is attached to the handle-end of the outer tube so that as the tubes are brought together, the piston shifts axially to vary the ratio between the left and right sections of the chamber or either side of the piston.

The piston is provided with valves that function alternately to allow oil to pass from the right section to the left section when the tubes are brought together by the handles in the compression stroke, and to allow oil to pass from the left section to the right section when the tubes are pulled apart in the expansion stroke. Because of the incompressibility of the oil, the motion in the course of both strokes is linear and affords uniform damping or resistance to motion throughout the entire stroke length, so that the exercising effect is even and free of strain variations in both expansion and contraction.

Each handle piece is constituted by a cylindrical cap which covers and protects the end of the tube to which it is attached, a U-shaped yoke secured to the base of the cap and having arms projecting therefrom and a handle bridging these arms, the handle having a longitudinal bore therein to receive the mid-portion of a crossbar, whereby the user may directly engage the handle with either arm or foot, or may engage the ends of the crossbar protruding from the handle with both hands or both feet.

Attached to the outer surface of the inner tube adjacent the inner end thereof is a scale which is readable with respect to a pointer on the inner end of the outer tube, whereby by rotating the inner tube relative to the pointer to a scale position indicating the number of exercise cycles performed by the exerciser in a unit period of time, the exerciser obtains a useful reading of his performance.

OUTLINE OF DRAWINGS

For a better understanding of the invention as well as other objects and further features thereof, reference is made to the following detailed description to be read in conjunction with the accompanying drawing wherein:

FIG. 4 is a longitudinal section taken through the exerciser;

FIG. 5 illustrates a first exercise mode using both hands;

FIG. 6 illustrates a second exercise mode using one hand and one foot;

FIG. 7 illustrates a third exercise mode using both feet and both hands; and FIG. 8 is a table showing the relationship of muscle working units to fitness level.

DESCRIPTION OF INVENTION

Figure 1:
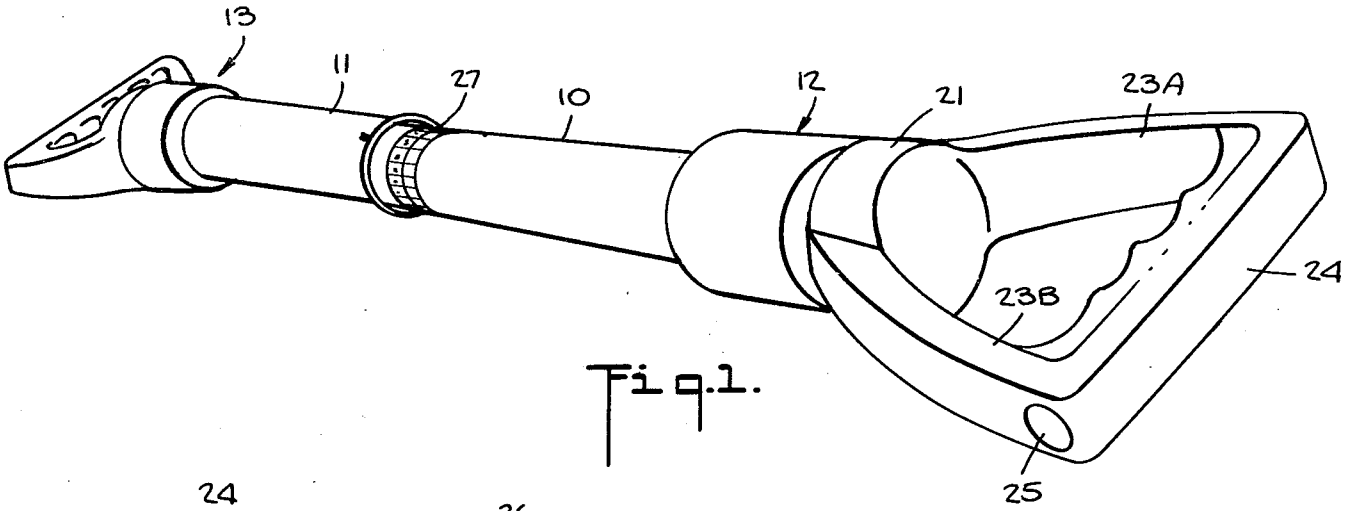
FIG. 1 is a perspective view of a push-pull hydraulic exerciser in accordance with the invention.
Figure 2:
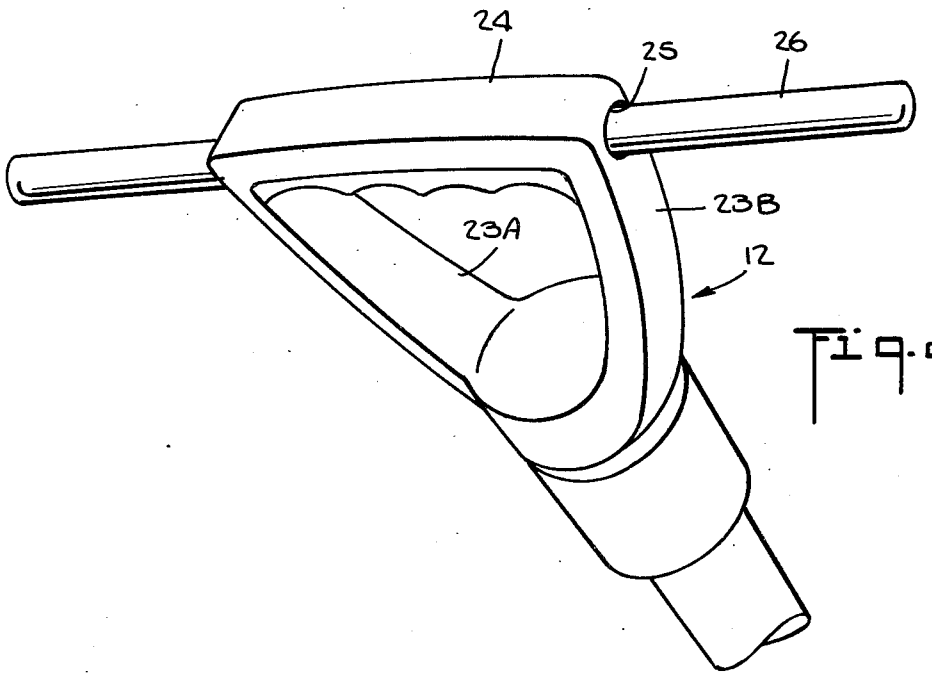
FIG. 2 is a partial view of the same exerciser with crossbars inserted in the handle pieces.

Referring now to the drawings, there is shown a push-pull isokinetic exerciser in accordance with the invention and including a bar formed by inner and outer telescoping tubes 10 and 11. The tubes may be made of a light-weight metal such as aluminum or synthetic plastic material such as high strength nylon or polypropylene.

The diameter of inner tube 10 is smaller than that of outer tube 11, so that tube 10 is receivable within tube 11 and is rotatable relative to tube 11. Attached to the end of tube 10 is a single-grip handle piece 12, and attached to the end of tube 11 is an identical handle piece 13.

In the exercise mode, the tubes may be pulled apart by the user by grasping their handle pieces with his hands and moving the hands away from each other and the tubes may be brought together by moving the hands toward each other.

As illustrated in FIG. 4, inner tube 10 is sealed at both ends to define a chamber which is oil-filled, preferably with a light-weight oil. Disposed within the chamber is a piston 14 whose actuating rod 15 projects from the end of the inner tube and is attached to the handle-end of the outer tube 11. Piston 14 is provided with flap-valves 16 of the type used in standard automotive shock absorbers. These valves alternately allow oil to pass through the piston in one direction only and act effectively as a throttle valve to produce a damping action resisting the compression of the exerciser and the expansion thereof.

When piston 14 travels to the right, the oil is forced through one flap valve into the left-hand section of the chamber, and when the piston moves back to the left, the oil flows through the other flap valve back into the right-hand section. The left-hand section of the chamber is somewhat smaller than the right-hand section even when the piston is positioned at the center of the chamber, due to the presence of the piston rod in the left-hand section. It is necessary, therefore, to provide a storage cavity 17 to compensate for this inequality.

The arrangement is such that when compression occurs, as shown in FIG. 4, oil passes through a spring-biased valve 18 into the storage cavity 17 which surrounds the main chamber, the valve allowing oil to pass in both directions. However, valve 18 is designed to present a higher flow resistance in compression, for then the oil is not discharged through the orifice of the valve but is forced through the narrow gaps of plates. On expansion, the oil which was forced into the storage cavity flows back into the chamber through the valve orifice without encountering much resistance.

Handle pieces 12 and 13 are molded out of a suitable high-strength synthetic plastic material, such as polyethylene or PVC. The two pieces are identical; hence only handle piece 12 will be described in detail. This piece includes a cylindrical cap 19 that is received over the handle-end of the inner tube 10 to protectively cover this end. Embedded in base 20 of cap 19 is a nut 21 which is threadably received on a bolt 22 projecting axially from the end of inner tube 10, thereby securing the handle piece to this end. Integral with base 20 and projecting therefrom is a U-shaped yoke formed by a pair of arms 23A and 23B whose extremities are bridged by a handle 24. The inner wall of handle 24 is scalloped to facilitate finger gripping.

Thus the handle pieces, which serve to protectively cover the handle-ends of the inner and outer telescoping tubes of the bar and to avoid catching of clothing in these ends, make it possible for a user to hold the exerciser between his hands and to pull the tubes in and out in the manner shown in FIG. 5 or between either hand and either foot in the manner shown in FIG. 6.

For some exercises, it is necessary to effectively enlarge the handle pieces so that each may be manipulated by two hands or two feet, making it possible, for example, for two individuals to use the same exerciser—one person grasping one handle piece with both hands and the other person grasping the other handle piece in the same way.

To this end, the handle of each piece is provided with a longitudinal bore 25 through which one may insert a crossbar 26 whose end portions project from the handle at either side thereof to afford a symmetrical pair of handle extensions. The handle piece is molded of synthetic plastic material having some degree of resilience with annular ribs formed within bore 25. The crossbar is preferably formed of chrome-plated metal tubing whose diameter matches that of the bore, the bar being engaged and held in place by the yieldable internal bore ribs (not shown). These crossbars, as shown in FIG. 7, also make it possible for an individual exerciser to operate the device with his two hands gripping the crossbar at one end, and his two feet engaging the crossbars at the other end, so that all extremities of the body can be subjected to an exercise regimen.

The exerciser in accordance with the invention lends itself to a program based on how many push-pull cycles one can carry out in a unit of time (60 seconds). Each cycle involves a complete compression and expansion of the hydraulic bar.

As pointed out previously, because of the incompressibility of the oil in the tube, the motion in the course of both strokes in a full cycle is linear and affords uniform resistance to motion (isotonic) throughout the entire stroke length, so that the exercising effect is even and free of strain variations in both expansion and contraction. Moreover, with each phase of the workout cycle, one transfers from contraction to relaxation to contraction, and there exists a brief recovery period sufficient to eliminate exercise residuals and to minimize fatigue.

Figure 3:
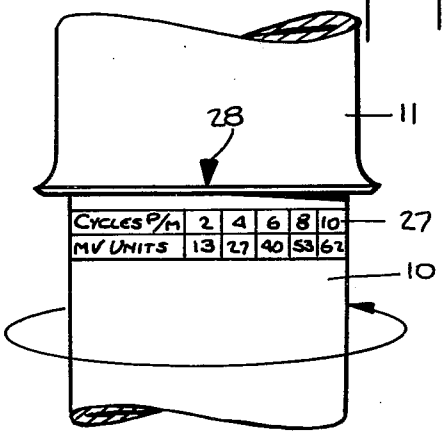
FIG. 3 illustrates the scale on the exerciser.

The workout cycles are translated on a scale into muscle working units or MWU's. Thus one who carries out twelve cycles of exercise in 60 seconds achieves 80/12; that is, eighty MWU's over 12 cycles. The MWU scale is incorporated in the exerciser. As shown in FIG. 3, attached to the inner end of inner tube 10 is an annular scale 27 which encircles the tube and is visible to the user only when the inner tube 10 is fully pulled out. By rotating inner tube 10 relative to the outer tube 11, one thereby turns the scale relative to a pointer 28 on the inner end of the outer tube to obtain a MWU reading. Thus when a user works out for one minute and counts the number of cycles he performs in that time, he can then immediately check the scale to determine his muscle working units.

To evaluate his performance, the user makes use of a measurement and evaluation chart of the type shown in FIG. 8 in which the scale formed by MWU's over cycles per minutes is divided into fitness levels.

It will be seen that five levels are provided, the first being Sub-par, the second Minimum, the third Average, the fourth Physically-gifted and the fifth Superman. Each level is sub-divided into three steps. Thus one who performs 14 to 18 cycles per minute with the exerciser produces MWU's in a 93 to 120 range and falls into a level 111 which is Average. Within this level, there is a low, a medium and a high step. By recording the performance level for each of the various exercises directed to different muscle and body areas (upper torso, trunk, chest, etc.), one can obtain a comparison chart indicative of the user's progress.

The exerciser in accordance with the invention may be held between the hands or between either foot and either head and expanded and contracted at virtually any body position, thereby making it possible to exercise almost all body regions and muscle groups.

Thus for Upper Torso; chest, arms and shoulder muscle development, the appropriate exercise position is to stand gripping the exerciser with the hands in front of the chest with the arms slightly flexed, the telescoping bar being then pulled in and out as many times as one is capable of in 60 seconds.

For Trunk; stomach, back and arm muscles, the user sits in a chair holding the exerciser upright with both hands on the upper handle, the lower handle being engaged by one foot. The upper handle is then pulled up and pressed down for one minute.

These are but a few of the many possible exercise programs with an isokinetic exerciser in accordance with the invention.

While there has been shown a preferred embodiment of a push-pull isokinetic exerciser in accordance with the invention, it will be appreciated that many changes and modifications may be made therein, without, however, departing from the essential spirit thereof.

I claim:

1. A push-pull isokinetic exerciser affording substantially uniform resistance to motion throughout its expansion and compression strokes, said exerciser comprising:

A. a hydraulic bar formed by inner and outer telescoping cylindrical tubes having handle-ends, each provided with an axially-projecting bolt, said tubes being rotatable relative to each other, said inner tube being sealed at both ends to define an oil-filled chamber, said inner tube enclosing a piston whose actuating rod is attached to the handle-end of the outer tube so that as the tubes are brought together, the piston shifts axially to vary the ratio between the left and right sections of the chamber on either side of the piston, said piston having valves therein functioning alternatively to allow oil to pass from the right to the left section when the tubes are brought together in the compression stroke and to allow oil to pass from the left to the right section when the tubes are pulled apart in the expansion stroke; and B. handle pieces attached to the handle-ends of the inner and outer tubes, each piece being constituted by a cylinder cap which concentrically covers and protects the end of the tube to which it is attached, a U-shaped yoke secured to the base of the cap and having arms projecting therefrom and a handle bridging these arms, the cap, yoke and handle of each handle-piece being integral with each other and being formed to synthetic plastic material, each cap base having a nut embedded therein to threadably receive the bolt projecting from the handle end of the associated tube to provide a connected and safe attachment therefor.

2. An exerciser as set forth in claim 1, wherein the inner wall of the handle is scalloped to afford a finger grip.

3. An exerciser as set forth in claim 2, wherein said handle is provided with a longitudinal bore and further including a crossbar insertable in said bore to extend from either side thereof to provide foot rests, making it possible to engage said piece with two hands or two feet.

4. An exerciser as set forth in claim 1, further including an annular scale encircling said inner tube adjacent the inner end thereof whereby said scale is covered by the telescoping outer tube except when the outer tube is fully extended relative to the inner tube, rotation of said inner tube causing said scale to turn relative to a pointer in said outer tube.

5. An exerciser as set forth in claim 4, wherein said scale is calibrated in muscle working units.

6. An exerciser as set forth in claim 1, wherein said inner tube further includes a storage cavity surrounding said chamber and a bi-directional valve between said cavity and said chamber to allow oil to pass in both directions, said cavity compensating for the inequality of said sections as a result of the presence of said rod in one of said sections.

* * * * *

UNITED STATES PATENT OFFICE

CERTIFICATE OF CORRECTION

Patent No. 4,148,479 Dated APRIL 10, 1979

Inventor(s) DONALD SPECTOR

It is certified that error appears in the above-identified patent and that said Letters Patent are hereby corrected as shown below:

COLUMN 7, LINE 11 "TO" SHOULD HAVE READ -- OF --

Signed and Sealed this

*Thirty-first* Day of *July 1979*

[SEAL]

*Attest:*

*Attesting Officer*

LUTRELLE F. PARKER

*Acting Commissioner of Patents and Trademarks*